US005860809A

United States Patent [19]

Meehan

[11] Patent Number: 5,860,809

[45] Date of Patent: Jan. 19, 1999

[54] LIPSTICK DISPLAY AND DEVICE

[76] Inventor: Frank P. Meehan, 203 Cathedral Ave., Hempstead, N.Y. 11550

[21] Appl. No.: 905,476

[22] Filed: Aug. 4, 1997

[51] Int. Cl.[6] ..... G09B 19/00

[52] U.S. Cl. ..... 434/100; 434/371

[58] Field of Search ..... 434/99, 100, 371

[56] References Cited

U.S. PATENT DOCUMENTS

| | | | |
|---|---|---|---|
| 1,979,119 | 2/1934 | Radinsky . | |
| 2,085,180 | 6/1937 | Bevis | 434/371 |
| 2,168,352 | 8/1939 | Lawry | 434/371 |
| 2,623,304 | 12/1952 | Watson | 434/100 |
| 3,295,690 | 1/1967 | Ottman | 434/371 X |
| 3,659,928 | 5/1972 | Macfarlane | 434/371 X |
| 3,809,785 | 5/1974 | Calabrese et al. | 434/100 |

FOREIGN PATENT DOCUMENTS

| | | | |
|---|---|---|---|
| 1110340 | 2/1956 | France | 434/100 |

*Primary Examiner*—Jeffrey A. Smith
*Attorney, Agent, or Firm*—Ladas & Parry

[57] ABSTRACT

A lipstick display device having a mirror surface provided with a lip-shaped cut-out therein and an optical system for projecting from behind the mirror a color image at the cut-out. The color image is formed by producing an image of one of a plurality of lipstick colors arranged in an array on a microfiche film. The lipstick colors are arranged in the array in rows and columns, each lipstick color representing a basic lip color without applied lipstick onto which a particular color lipstick is applied. The lipstick colors in the columns are grouped according to respective basic lip colors and in the rows are grouped according to different lipstick colors. A separate stand-alone display of the array is also provided.

20 Claims, 2 Drawing Sheets

LIPSTICK DISPLAY AND DEVICE

FIELD OF THE INVENTION

The invention relates to methods and apparatus for displaying to a customer an accurate representation of a lipstick product as it would appear on the lips of the customer.

BACKGROUND

The practice of selecting lipstick products on the basis of application of the lipstick product on the lips of the customer is currently in disfavor due to its unsanitary nature and its potential for transmitting disease from customer to customer. However, selection of the lipstick product on the basis of solely viewing the color thereof is not reliable principally due to the differences between the basic lip color of different people and the different colors produced when the lipstick is applied to the different color lips. The reason for this is that lipstick is not opaque but has a measure of transparency and the ultimate appearance of the lipstick is a function both of the color of the lipstick and of the lips of the user.

A further problem arising in lipstick selection is the absence of uniformity of the ambient lighting and accordingly a difference in perceived color of the lipstick product under different lighting conditions.

In order to aid in the selection of lipstick color by a user, U.S. Pat. No. 1,979,119 discloses a hand held mirror having a lip shaped aperture in the mirror and a movable member behind the mirror carrying colored areas adjusted to be selectively brought into registration with the aperture and thus place a colored representation of a pair of lips on the mirror which will be superimposed on the reflection of the face of the user. In this way, the user will obtain a simulated appearance of her lips with selected lipstick colors. However, the colored areas on the movable member are not true representations of what the actual lipstick product will look like when applied to the lips of the user.

SUMMARY OF THE INVENTION

An object of the invention is to provide a method and apparatus by which a user will be furnished with a highly accurate representation of the appearance of a lipstick product on the lips of the user.

A further object of the invention is to provide such a method and apparatus which will provide a large selection of different lipstick colors from which to choose.

Yet another object of the invention is to provide a display apparatus by which the user will be able to view a simulation of a large number of different lipstick products as they would appear on the lips of the user.

In order to satisfy the above and further objects, the invention provides a lipstick display device comprising a housing having a reflective mirror surface provided with a lip-shaped cut-out therein such that a person disposed in front of said mirror surface can see a reflected image of the face of the person except for the lips of the person, and optical means for projecting from behind said mirror a color image at said cut-out which represents a selected lipstick color applied to the lips of the person.

The optical means comprises a light source, a film having an array of lipstick colors thereon, and a lens arrangement for producing an image of one of the lipstick colors in said array at said cut-out. The lipstick colors in said array are arranged in rows and columns, each lipstick color in said array representing a basic lip color (without applied lipstick) onto which a particular color lipstick is applied. The lipstick colors in the columns are grouped according to respective basic lip colors and in the rows they are grouped according to different lipstick colors.

The display device further comprises control means operated by the user (1) to select a particular column of said array whose basic lip color corresponds to that of the user, and (2) to select a particular row in said column representing a specific lipstick color, the particular lipstick color at the selected row and column being representative of said specific lipstick color applied to the lips of the user, and means for shifting said array in correspondence with the selected row and column to position the particular lipstick color on the film to face the light source so that an image of said particular lipstick color will be produced at said cut-out.

In further accordance with the invention, the control means includes a manually engageable device having a first control member to select a column and a second control member to select a row.

Preferably, said film comprises a microfiche.

The lipstick display device includes a support for the microfiche which is movable along X and Y axes in correspondence with the selected column and row.

The lipstick display device further comprises means for controlling intensity of said light source.

Additionally, lights are provided on the housing for illuminating the face of the user, and in accordance with the invention, the intensity of the lights is controlled by the user.

The control of intensity of the lights on said housing can be correlated with a control for intensity of the light source of the optical means so that the illumination of the face of the user and the light intensity of the projected lip color image will be maintained substantially independent of ambient lighting.

Preferably, the housing of the lipstick display device will be mounted on a support surface and be vertically adjustable to adapt its elevation to users of different height.

The lipstick colors in the array can be arranged in a plurality of groups of columns, the columns in each group respectively corresponding to the same basic lip colors.

The invention also contemplates a free standing lipstick display comprising an array of lipstick color samples arranged in rows and columns, each of said color samples comprising a basic lip color onto which a particular lipstick color is applied, said color samples in said columns corresponding to different and respective basic lip colors and in the rows corresponding to different and respective lipstick products, whereby the choice of a lipstick product is made by the user on the basis of a selected color sample in said array in the column corresponding to the basic lip color of the user and onto which said lipstick color has been applied.

The lipstick display can be effectively utilized in combination with means for arranging lipstick products below said array so that a lipstick product can be retrieved based on the selected lipstick color from the array.

The invention further contemplates a method for selection of lipstick products based on an accurate representation of the appearance of the products on the lips of the user, said method comprising providing an array of lipstick colors arranged in rows and columns, each of said colors comprising a basic lip color onto which a color of a particular lipstick product is applied, said colors in said columns corresponding to different and respective basic lip colors and in the rows corresponding to different and respective lipstick products, said user choosing a selected color in said array in the column corresponding to the basic lip color of the user and onto which said color of the lipstick product has been applied, providing information on said array to indicate the lipstick product in said rows so that when the user selects the color in said array the user will be informed which lipstick product will produce this said color on the lips of the user, and arranging lipstick products below said array whereby the user can remove the particular lipstick product from the arrangement therebelow.

DETAILED DESCRIPTION OF A PREFERRED EMBODIMENT

Figure 1:
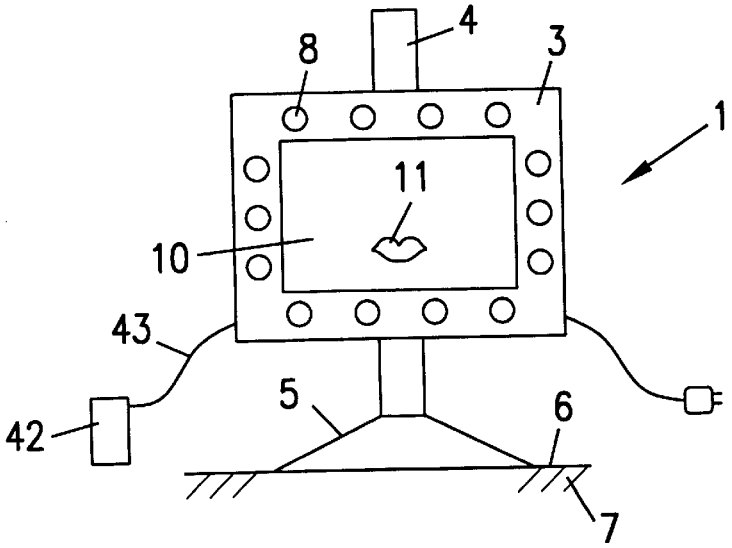
FIG. 1 is a front view of a lipstick display device of the invention.
Figure 2:
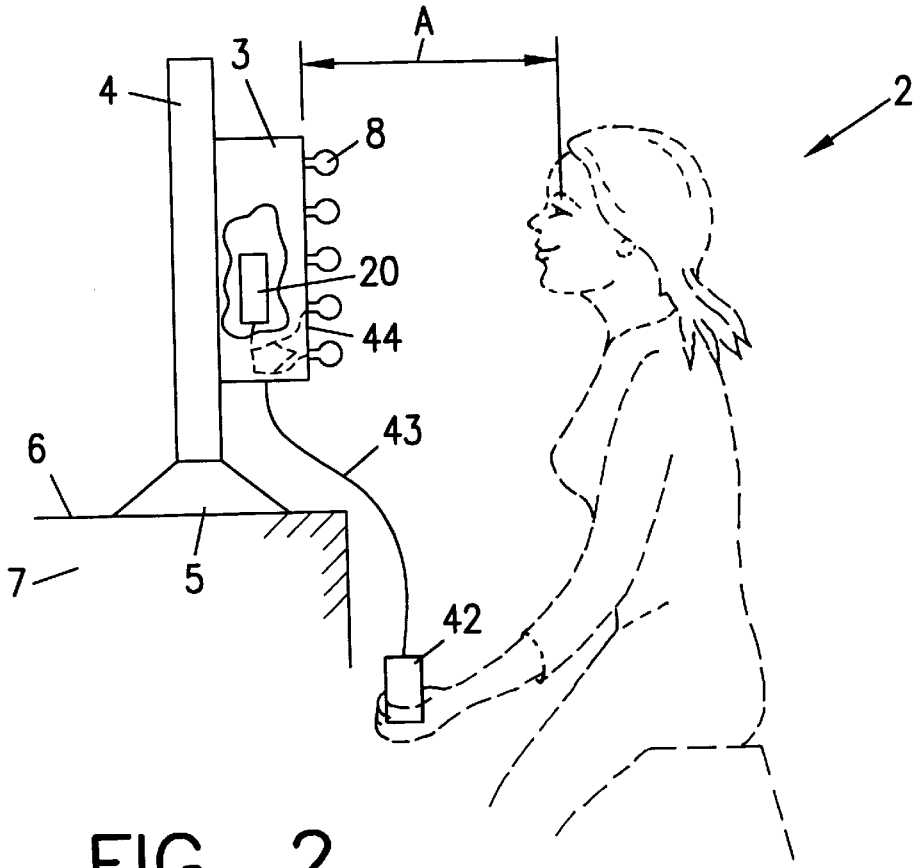
FIG. 2 is a side view, partly broken away, showing the lipstick display device in use.

Referring to the drawing, therein is seen a lipstick display device 1 adapted to provide an image of the face of a user 2 positioned in front of the display device and wherein the image will be provided with an accurate simulated representation of a selected lipstick color as it would appear on the lips of the user.

The display device 1 has a housing 3 mounted on a vertical column 4 for height adjustment for the particular user. Any conventional lockable slide arrangement is suitable for this purpose. The column 4 has a base 5 which rests on a surface 6, for example, of a counter 7. A number of light bulbs 8 are mounted around the perimeter of the housing 3 to provide a standard illumination of the face of the user.

The housing 1 contains a reflective mirror having a mirror surface 10, on which an image of the face of the user will be produced. The mirror surface has a lip-shaped cut-out 11 at a location corresponding to that at which the lips of the user would appear when facing the mirror. Accordingly, the mirror will reflect an image of the face of the user except for the lips of the user.

Within the housing is an optical means 20 for projecting from behind the mirror surface 10 a color image at the cut-out 11 which will represent a selected lipstick color as it would appear if applied to the lips of the user.

The optical means 20 comprises a light source 21 for producing a beam of light 22 which passes through a lens 23 and illuminates an area of a film 24, in a manner to be described more fully later, to pass an image of the color area on the film through a second lens 25 to a screen 26 located adjacent to the cut-out 11 in the mirror surface 10 to produce an image of the color area at the cut-out 11 which will be visible to the user 2. Hence, when the user looks in the mirror, the user will see a reflection of her face including an image of the color at the lip cut-out 11. The film 24 preferably is a microfiche and the screen 26 is a high transparency rear projection screen so that the color on the microfiche will be reproduced with high color accuracy at the cut-out 11. The image of the projected color will have an illumination from the light source 21 which is correlated to that from the light bulbs 8 to provide substantially equal illumination of the reflected face image and that of the image of the color area and the illumination of the image and lips will be substantially independent of ambient light conditions.

A feature of the invention is that it takes into account the fact that the underlying lip color of the user (referred to as the basic lip color) influences the final appearance of the lipstick product or sample when it is applied to the lips of the user. The reason for this is that the lipstick sample or product is not opaque but has a measure of transparency which is a function of the color and composition of the particular lipstick product. Accordingly, as most user are aware, the color of the lipstick product when applied to the lips of the user will not be the same as the actual color of the lipstick product itself. According to the invention, the basic lip color of the user is taken into account in simulating the apparent color of the lips when a particular lipstick product is applied to the lips of the user. For this purpose, it is considered that the basic lip colors of users falls into four classes varying from light to dark as shown at 31, 32, 33 and 34 at the top of the film 11 for illustrative purposes. A greater number of basic lip colors can be provided if necessary. The basic lip colors 31–34 are shown at a top row of an array 30 of color areas on the film 11 in rows and columns to be explained hereafter.

At the extreme left column 35 of the array 30 are arranged a number of areas representing different lipstick products, designated $\mathbf{36}_1$, $\mathbf{36}_2$ . . . $\mathbf{36}_n$, it being understood that the number of lipstick products is arbitrary and, for example, can represent a particular product line of a specific manufacturer. The use of areas $\mathbf{36}_1$ . . . $\mathbf{36}_n$ is for convenience of illustration and instead can simply be the manufacturer's designation of the lipstick product by name and/or number. In each column, there will be placed an area corresponding, in color, to the color of the lipstick product applied to the particular basic lip color. Thus, in the column corresponding to basic lip color 31, there will appear a number of color areas $\mathbf{31}_1$, $\mathbf{31}_2$ . . . $\mathbf{31}_n$ which are representative of the colors of the lipstick products $\mathbf{36}_1$, $\mathbf{36}_2$ . . . $\mathbf{36}_n$ applied to the basic lip color 31. The color areas in the column corresponding to basic lip colors 32, 33 and 34 represent the color of the lipstick products $\mathbf{36}_1$, $\mathbf{36}_2$ . . . $\mathbf{36}_n$ applied respectively to basic lip colors 32, 33, 34. A second array $\mathbf{30}_1$ can be provided adjacent to array 30 to include color areas corresponding to an additional product line of the manufacturer. A greater number of arrays can be provided for additional product lines. Each array will have the lipstick products varying in the rows and the basic lip colors varying in the columns. This arrangement is described for ease of illustration and, as will be evident to those skilled in the art, the array can be reversed and the basic lip colors arranged in rows and the lipstick products in columns. Therefore, in the description, and claims which follow, the reference to the rows and columns of the array is used interchangeably.

In order for the user to select a particular area of the color array 30 on the film 24 to be displayed at the cut-out 11, the film 24 is supported on a frame 40 which is supported from the housing 3 by an adjusting mechanism 41 permitting displacement of the frame 40, and the film 24 therewith, in X and Y directions corresponding to the rows and columns of the array 30. The adjusting mechanism 41 can be constructed as a conventional rack and pinion device as well known to those skilled in the art. The adjusting mechanism 41 is connected to a control box 42 by which the frame 40 can be displaced to select a particular color area to be displayed. The connection of the control box 42 to the adjusting mechanism 41 can be by a cable 43 or be wireless. The control box 42 is also connected by a line 44 in cable 43 to the light source 21 and to the lights 8 to vary the illumination thereof, in concert, to enable the user to see the effect of the selected lipstick color on the reflection of the face of the user under different lighting conditions. Instead of being portable, as shown, the control box 42 can be fixed to the housing 3.

The microfiche is replaceable in the housing to provide different color arrays depending on product and seasonal changes.

In use, the user positions herself in front of the mirror surface 10 and adjusts the housing 3 vertically so that the cut-out 11 will be at the position of the user's lips. The user will then assess which of the basic lip colors 31–34 corresponds to the lips of the user. A function button (not shown) on the control box 41 is operated by the user to select the basic lip color and a separate function button is operated to select various colors from the array to be projected on the screen at the cut-out 11 so that the user can see various lipstick colors on the reflection of her face. Numerical indicators on the control box or the screen can advise the user of the basic lip colors and the lipstick product. The film 24 will be shifted in the X and Y directions in accordance with the operation of the function buttons to position the color areas in the light beam 22. By way of example, if the user has selected basic lip color 32 and lipstick product $\mathbf{36}_n$, the film will be displaced to position area $\mathbf{32}_n$ in the path of the light beam. If a second array $\mathbf{30}_1$ of grouped basic lip colors and sample colors is provided and the user makes a selection from the second array, the control box 42 will cause the adjusting mechanism 41 to shift the frame 40 to position the column corresponding to the selected basic lip color (the second column in the illustrated sample) and the row corresponding to the selected lipstick product.

Figure 3:
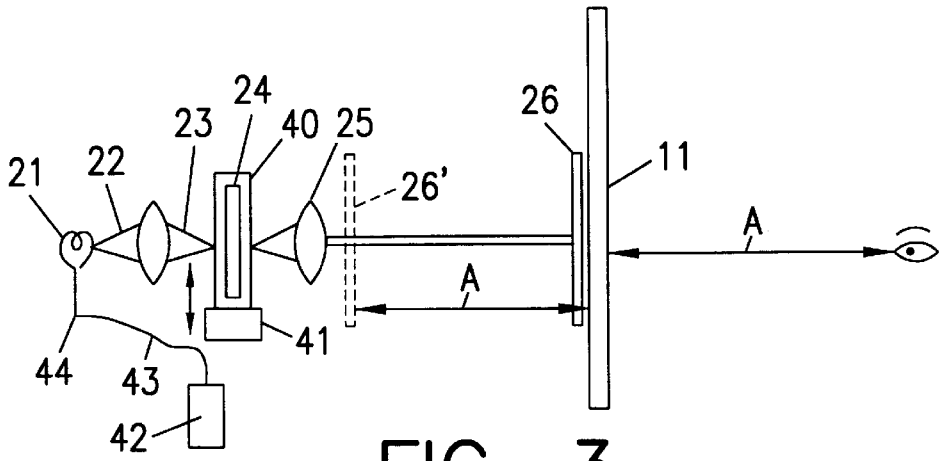
FIG. 3 diagrammatically illustrates a portion of the lipstick display device.

When the screen 26 is located adjacent to the mirror as shown in FIG. 3, the user needs to close one eye in order to correctly perceive the lip image on the reflected image of the user's face. However, to avoid the need to close one eye, the screen 26 is placed at a distance back from the mirror 10 equal to the distance A of the user from the mirror as shown in dotted position 26' in FIG. 3. The optical means will be positioned to focus the image of the areas on the film on the screen 26'.

Instead of providing the basic lip colors 31-34 on the microfiche film 24, the basic lip colors can be directly provided on the housing 3 or elsewhere suitable for viewing by the user.

Figure 4:
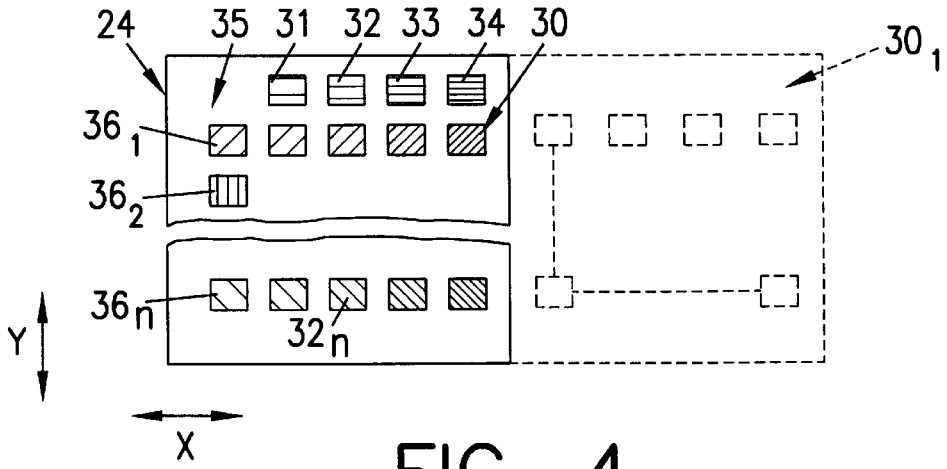
FIG. 4 illustrates a microfiche film of the display device, broken in length.

The array shown in FIG. 4 can also serve as a stand-alone display for placement on the counter surface or as a wall poster. The stand-alone display will include the basic lip colors 31-34 thereon. Even though the user will not be able to see the reflection of the lipstick color applied on the basic lip color on the face of the user as with the mirror display device 1, nevertheless the user will be able to see on the array the effect of applying a particular lipstick sample on the basic lip color of the user. In making a selection of a lipstick product, the user chooses a color area from the column corresponding to her basic lip color and then finds the particular lipstick product, which will produce this color on her lips, by the row looking across to the left column 35 of the array where the identification of the lipstick products is given. Therefore, instead of the current practice of selecting a lipstick color on the basis of the color of the lipstick sample itself, (which will change when applied to the lips of the user) according to the invention, the user selects the desired color from the array, which represents a lipstick product as applied to her basic lip color, and from this obtain the particular lipstick product.

Figure 5:
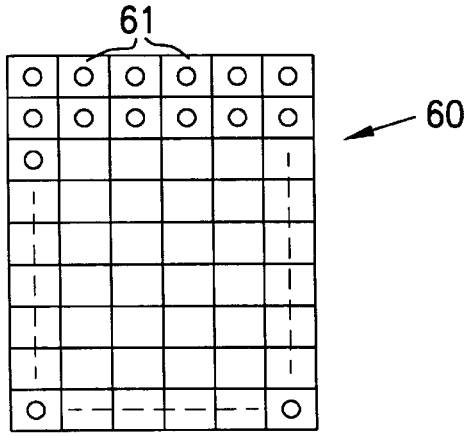
FIG. 5 diagrammatically illustrates a cabinet for lipstick products usable in combination with the display device.

It will be particularly advantageous to arrange the lipstick products beneath the display as shown in FIG. 5, where a cabinet 60 is shown with movable trays 61 adapted for being supplied with lipstick products by gravity feed as conventionally used in the art. At the front of the trays, the lipstick samples are identified by product name and arranged in alphabetical order to facilitate easy retrieval.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. Lipstick display device comprising:

a housing having a reflective mirror surface, said mirror surface being provided with a lip-shaped cut-out therein such that a person disposed in front of said mirror surface can see a reflected image of the face of the person except for the lips of the person, and means for projecting from behind said mirror a color image at said cut-out which represents a selected lipstick color applied to the lips of the person, said means comprising a light source, a film having an array of lipstick colors therein, and a lens arrangement for producing an image of one of the lipstick colors in said array at said cut-out, said lipstick colors in said array being arranged in rows and columns, each lipstick color in said array representing a basic lip color without applied lipstick onto which a particular color lipstick is applied, the lipstick colors in the columns being grouped according to respective basic lip colors and in the rows being grouped according to different lipstick colors, control means operated by the user (1) to select a particular column of said array whose basic lip color corresponds to that of the user, and (2) to select a particular row in said column representing a specific lipstick color, the particular lipstick color at the selected row and column being representative of said specific lipstick color applied to the lips of the user, and means for shifting said array in correspondence with the selected row and column to position the particular lipstick color to face the light source so that an image of said particular lipstick color will be produced at said cut-out.

2. The lipstick display device as claimed in claim 1, wherein said control means includes a manually engageable system having a first control member to select a column and a second control member to select a row.

3. The lipstick display device as claimed in claim 2, comprising indicator means associated with said control members for indicating the particular row and column location of the lip color selected by the user.

4. The lipstick display device as claimed in claim 1, wherein said film comprises a microfiche.

5. The lipstick display device as claimed in claim 4, comprising a support for said microfiche which is movable along X and Y axes in correspondence with the selected column and row.

6. The lipstick display device as claimed in claim 1, comprising means for controlling intensity of said light source.

7. The lipstick display device as claimed in claim 1, comprising lights on said housing for illuminating the face of the user.

8. The lipstick display device as claimed in claim 1, comprising means for controlling intensity of said light source, said display device further comprising lights on said housing for illuminating the face of the user, and means for correlating the intensity of said light source and of said lights.

9. The lipstick display device as claimed in claim 1, comprising means for supporting said housing on a support surface, and means for vertically adjusting said housing relative to said support surface.

10. The lipstick display device as claimed in claim 1, wherein said array of lipstick colors are arranged in a plurality of groups of columns, the columns in each group respectively corresponding to the same basic lip color.

11. The lipstick display device as claimed in claim 10, wherein said control means is operative to select the columns having the same basic lip color when making selections from one group or another.

12. The lipstick display device as claimed in claim 1, comprising a screen onto which said image is projected for viewing at said cut-out.

13. The lipstick display device as claimed in claim 12, wherein said screen is positioned adjacent to said cut-out.

14. The lipstick display device as claimed in claim 13, wherein said screen is positioned at a distance behind the mirror substantially equal to the distance of the user from the mirror.

15. A lipstick display comprising:

a substrate, an array of lipstick color samples arranged on said substrate in a plurality of rows and a plurality of columns, each of said color samples comprising a basic lip color onto which a particular lipstick color is applied, said color samples in said columns corresponding to different and respective basic lip colors and in the rows corresponding to different and respective lipstick colors, whereby the color samples for a number of different basic lip colors and for a number of different lipstick colors are all displayed concurrently, on said substrate so that users having different basic lip colors can choose a lipstick color from the display on the basis of a selected color sample in said array in the column corresponding to the basic lip color of each of the users and onto which said lipstick color has been applied.

16. A lipstick display as claimed in claim 15, wherein said array of lipstick colors are arranged in a plurality of groups of columns, the columns in each group respectively corresponding to the same basic lip color.

17. A lipstick display as claimed in claim 15, in which said substrate enables said lipstick display to constitute a standalone display in which the lipstick colors appear on said plurality of basic lip colors.

18. A lipstick display as claimed in claim 17, wherein said lipstick colors in said lipstick color samples have transparency and are fixed on said basic lip colors in said array, said lipstick color samples being fixed on said substrate.

19. A lipstick display as claimed in claim 18, wherein said lipstick display is in the form of a poster.

20. A lipstick display as claimed in claim 19, wherein said substrate is constructed to be supported on a counter surface.

* * * * *